US009085443B2

(12) United States Patent
Schuermann et al.

(10) Patent No.: US 9,085,443 B2
(45) Date of Patent: Jul. 21, 2015

(54) LOCKING SYSTEM FOR TELESCOPIC CRANE JIB WITH MOVABLE LOCKING UNIT

(75) Inventors: Johannes Schuermann, Jever (DE); Dieter Stuehrwoldt, Wilhelmshaven (DE)

(73) Assignee: Manitowoc Crane Group France SAS, Dardilly Cedex (FR)

( * ) Notice: Subject to any disclaimer, the term of this patent is extended or adjusted under 35 U.S.C. 154(b) by 739 days.

(21) Appl. No.: 12/693,768

(22) Filed: Jan. 26, 2010

(65) Prior Publication Data

US 2010/0187194 A1 Jul. 29, 2010

(30) Foreign Application Priority Data

Jan. 27, 2009 (DE) ..... 10 2009 006 292

(51) Int. Cl.
*B66C 23/62* (2006.01)
*B66C 23/70* (2006.01)

(52) U.S. Cl.
CPC ..... *B66C 23/708* (2013.01); *B66C 23/705* (2013.01)

(58) Field of Classification Search
USPC ..... 212/292, 348, 347, 264, 230, 349; 52/118
See application file for complete search history.

(56) References Cited

U.S. PATENT DOCUMENTS

| | | | | |
|---|---|---|---|---|
| 4,327,533 | A * | 5/1982 | Sterner | 52/115 |
| 5,628,416 | A * | 5/1997 | Frommelt et al. | 212/292 |
| 6,189,712 | B1 | 2/2001 | Conrad et al. | |
| 6,527,131 | B1 * | 3/2003 | Brockelmann et al. | 212/292 |
| 2003/0057172 | A1 * | 3/2003 | Harrington | 212/292 |
| 2012/0074089 | A1 * | 3/2012 | Willim et al. | 212/348 |

FOREIGN PATENT DOCUMENTS

| | | | |
|---|---|---|---|
| DE | 198 24 672 | A 1 | 5/1998 |
| DE | 20003355 | U1 | 8/2000 |
| DE | 101 42 847 | C1 | 11/2002 |
| DE | 102 23 449 | A1 | 12/2003 |
| EP | 0 476 225 | A2 | 4/1991 |
| EP | 0 476 225 | B1 | 4/1991 |
| EP | 1 293 471 | B1 | 8/2002 |
| JP | 1998-236768 | | 9/1998 |

* cited by examiner

*Primary Examiner* — Sang Kim
*Assistant Examiner* — Juan Campos, Jr.
(74) *Attorney, Agent, or Firm* — John C. Bacoch; Brinks Gilson & Lione

(57) ABSTRACT

The invention relates to a locking system for a telescopic crane jib, in particular for a mobile crane, in which a lock is established between a telescoping cylinder (10, 20) and a telescopic part (1-4) by means of a locking unit (21) in order to extract and retract the telescopic parts, and the locking unit (21) is disposed on the telescoping cylinder (10, 20) in such a way that it can be moved longitudinally.

18 Claims, 3 Drawing Sheets

LOCKING SYSTEM FOR TELESCOPIC CRANE JIB WITH MOVABLE LOCKING UNIT

CROSS REFERENCE TO PRIOR APPLICATION

This application is a Paris Convention Filing under 35 U.S.C. §119 and claims priority to and benefit from German Application DE 10 2009 006 292.0, filed on Jan. 27, 2009.

FIELD OF THE INVENTION

The invention relates to a locking system for a telescopic crane jib, in particular for a mobile crane.

As a means of moving several telescopic parts, such cranes and telescopic jibs are provided with a telescoping cylinder which has a locking unit. This locking unit is used to establish a lock between the telescoping cylinder and one of the telescopic parts which has to be extended or retracted.

This invention relates to a telescopic jib of the type whereby a telescoping cylinder extracts and locks jib parts. Modern mobile cranes are being used to lift increasingly heavier loads to ever greater heights. Users are also demanding an efficient mobile crane of the lowest possible intrinsic weight in order to save on logistics costs. Efforts are also being directed towards developing a mobile crane capable of handling the highest possible load on as few axles as possible within the permissible axial loads, to obtain greater flexibility on the one hand and reduce the overall cost of the crane on the other hand. The telescopic jib is a core element of the mobile crane; it determines the maximum lifting height and load-bearing capacity. The jib length is determined by the number and length of the individual telescopic parts. For static reasons, the individual telescopic parts must maintain an overlap in the extracted state to ensure good mutual traction perpendicular to the jib direction. The traction in the jib direction is obtained by locking the telescope. Depending on design, the telescopic parts may not be fully retracted one inside the other in the retracted state. Collar parts are provided at the front end to brace the telescopic parts, which project outwards. The points at which the telescope is locked are also disposed one in front of the other in the longitudinal direction. To enable the telescoping cylinder to be locked to a telescope part, therefore, it is necessary to travel a certain distance in the longitudinal direction of the jib in order to move the locking unit to a position on a level with the telescope to be locked. In the system known from the prior art, the telescoping cylinder together with the locking unit must be extracted by a certain distance for every telescopic part and thus loses a part of its overall extension. As a result, the front telescopic parts cannot be extracted as far as the rear ones, making allowance for the overall travel of the telescoping cylinder. This results in an unnecessarily big overlap of the front telescopic parts in the extracted state which is associated with a loss in terms of the total jib length.

The objective of this invention is to propose a locking system for a telescopic crane jib, which optimises the inward and outward telescoping action (movements), particularly in terms of extendable length.

This objective is achieved by the invention on the basis of a locking system as defined in claim 1. The dependent claims define preferred embodiments of the invention.

As proposed by the invention, the locking unit is disposed on the telescoping cylinder in such a way that it is able to move longitudinally. In other words, the position of the telescoping cylinder and the position of the locking unit are not determined by one another as is the case with the system known from the prior art. This being the case, the locking unit is able to move to a locking point without the telescoping cylinder moving or even with the telescoping cylinder moving in a different direction, which significantly increases functionality and reduces or eliminates restrictions affecting the working or operating mode. In particular, the distance by which the locking unit is able to move or the point which the locking unit is able to reach is no longer restricted by the extent to which the telescoping cylinder is able to move or its choice of disposition. This results in additional telescoping distance, saving length on the telescoping cylinder, which in turn reduces the overall jib weight, thereby optimising the crane as a whole.

The invention offers the option of mounting the locking unit on the telescoping cylinder in such a way that it can be fixed, in particular in such a way that it can be fixed in every position. It may also be designed as a second stage on the telescoping cylinder or be mounted on a second stage of the telescoping cylinder. At least one length-measuring device or a length transmitter 40 is also advantageously provided, which is able to detect the position of the locking unit and telescoping cylinder, in particular the relative position of the two or their absolute positions. As proposed by the invention, and particularly with this design, once the locking unit has assumed the correct position and has been locked to the co-operating telescope, a seat valve, for example, is closed and secured to the cylinder stage of the locking unit. In this way the locking unit can be fixed on the telescoping cylinder by means of a hydraulically assisted fixing means or system controlled by a seat valve. The structural-steel lock to the next telescopic part can then be released and the telescopic part which has just been locked to the locking unit can be extracted, thereby making the full extension of the telescoping cylinder available.

In one embodiment of the invention, the locking unit, in particular the second stage of the telescoping cylinder with the locking unit disposed on it, moves with the telescoping cylinder in the unlocked state free of force, as a result of which only slight forces are needed to move it, which can be applied by the hydraulic supply from the cylinder inlet used for extraction purposes if the locking unit can be moved on the telescoping cylinder by applying hydraulic force—as is the case with one embodiment of the invention.

A hydraulic circuit may be provided, which controls operation and/or the securing of the movable locking unit in conjunction with the hydraulic system used to actuate the telescoping cylinder. The retraction operation then preferably takes place by means of a releasable connection to the annular end of the telescoping cylinder. Using the locking system proposed by this invention, the overall stroke of an extended telescoping system can be divided between the movement of the locking unit and the telescoping distance of the telescoping cylinder, i.e. the telescoping cylinder may be made shorter in principle or the overall stroke can be increased, without having to make the telescoping cylinder longer.

In FIG. 1 the distance h2 is the distance between the jib-locks for first telescopic part 1 and the second telescopic part 2 when the jib is in a retracted state. The distance h3 is the distance between the jib-locks for first telescopic part 1 and the third telescopic part 3 when the jib is in a retracted state. The distance h4 is the distance between the jib-locks for first telescopic part 1 and the fourth telescopic part 4 when the jib is in a retracted state. In one embodiment, the locking unit can be moved on the telescoping cylinder by a distance h4 corresponding to at least the distance of all the telescopic jib-lock deactivation means, which is the distance between the first and last telescopic jib-locks when the jib is in the retracted state. Alternatively, another option is to make the locking unit so that it is able to move by more than this distance, in which case the movement is effected in addition to the stroke of the telescoping cylinder for the above-mentioned purpose or at least partially replaces it.

Other aspects of the invention will be explained in more detail with reference to examples of embodiments illustrated in the appended drawings. It may incorporate all the features described here, either individually or in any meaningful combination, and may also be construed and described in principle as a method of retracting and extending a telescopic crane jib as well as the use of the illustrated devices for this purpose. Of the drawings:

DETAILED DESCRIPTION OF THE INVENTION

Figure 1:
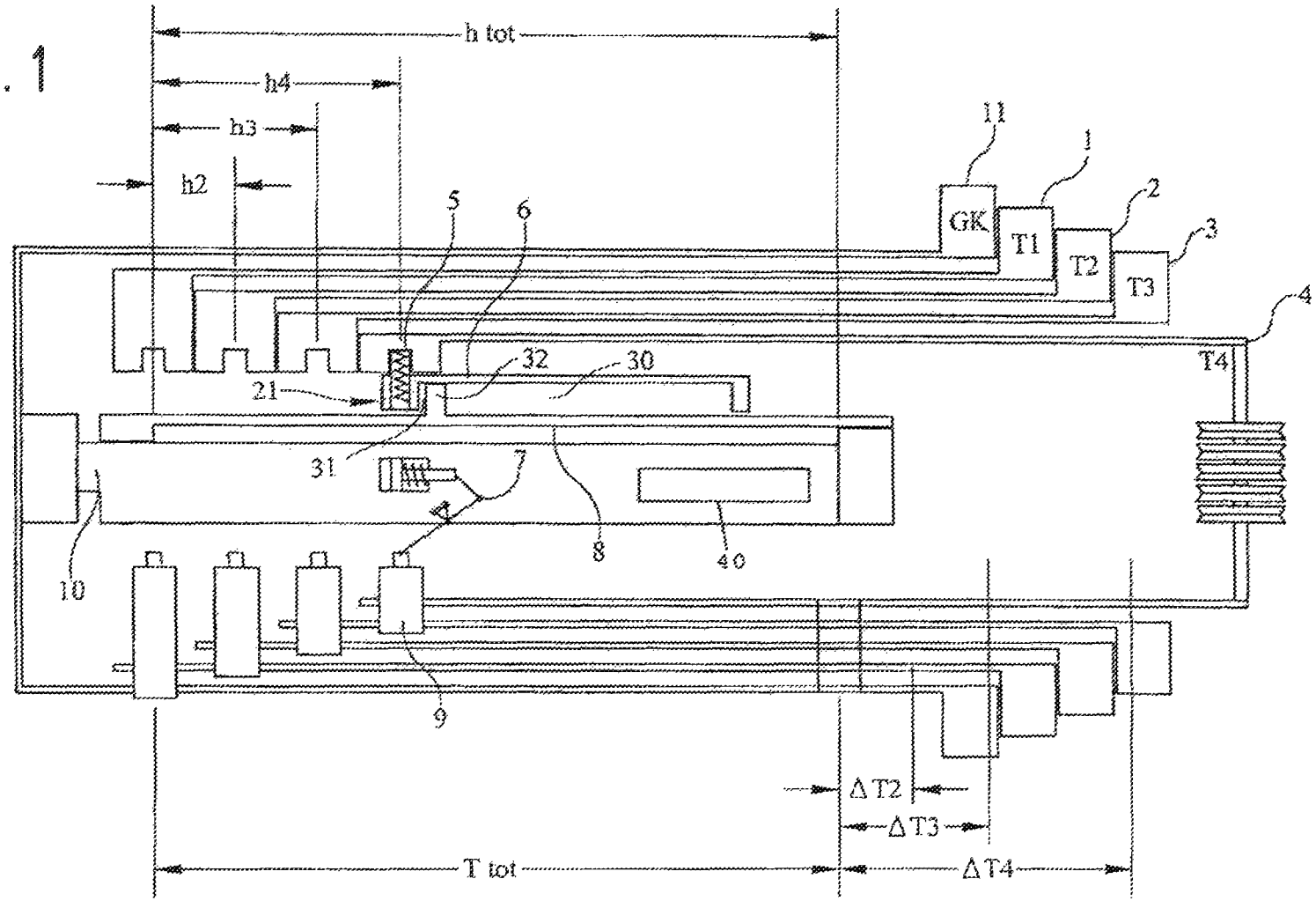
FIG. 1 shows a schematic view in longitudinal section of a telescopic jib with a telescoping cylinder and locking system as proposed by the invention.
Figure 3:
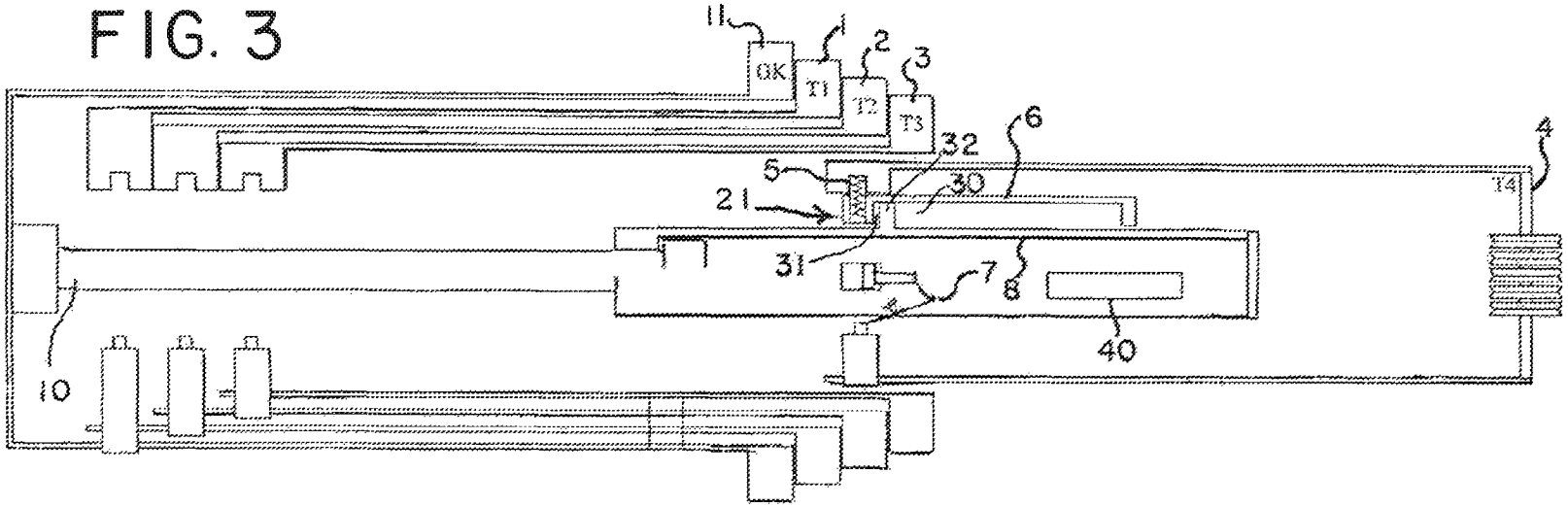
FIG. 3 shows a schematic view in longitudinal section of the telescopic jib of FIG. 1 with the telescoping cylinder fully extended and the locking system connected to extractable telescopic part 4.
Figure 4:
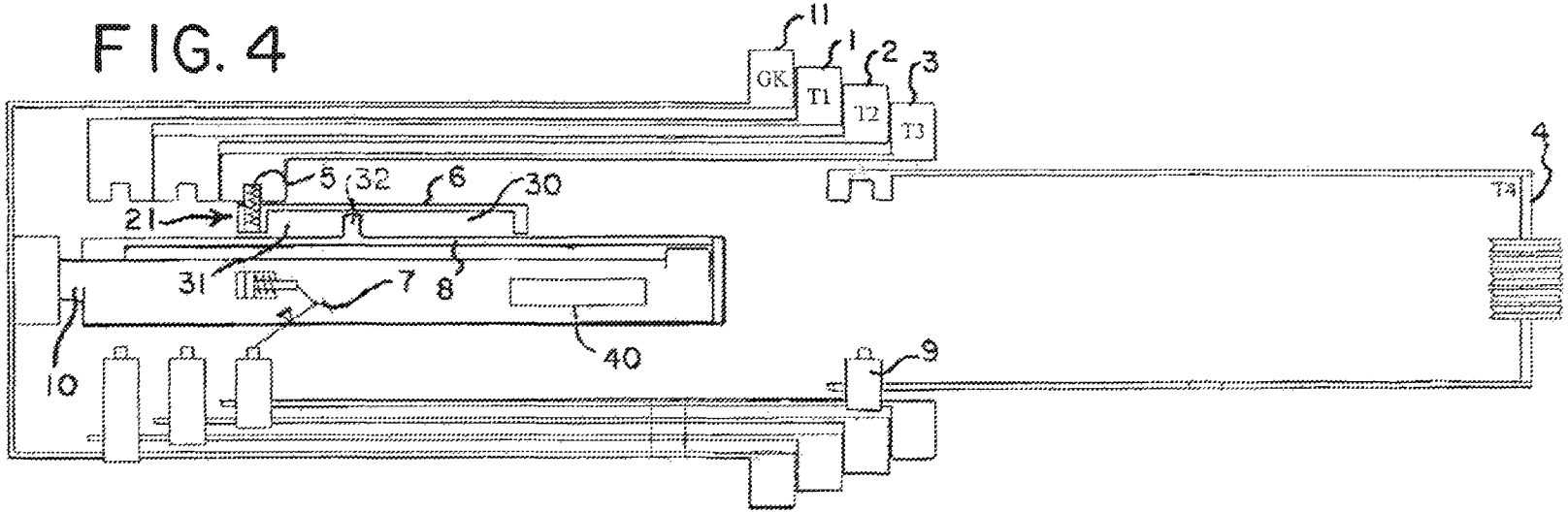
FIG. 4 shows a schematic view in longitudinal section of the telescopic jib of FIG. 1 with the extractable telescopic part 4 fully extended and the telescoping cylinder fully retracted and the locking system connected to extractable telescopic part 3.

An example of an embodiment of the invention will firstly be explained in more detail with reference to FIGS. 1 and 3-4. A schematic view in longitudinal section shows a telescopic jib, comprising a main body 11 and four extractable telescopic parts 1 to 4. The telescoping cylinder 10 is disposed in the main body 11. The locking unit 21, which comprises a second cylindrical stage 6 and the cylinder lock 5, extends on the external cylindrical casing of the telescoping cylinder 10. The second cylindrical stage 6 lies around the external tube 8 of the telescoping cylinder 10, which is illustrated separately. Also disposed on the telescoping cylinder 10 is the operating means 7 for the structural-steel lock 9, which locks the individual telescopic parts to one another when they are moved into operating mode.

The way in which the telescopic system is extended in the case of this type of embodiment—in particular automatically—is based on the sequence described below.

All the telescopic parts 1 to 4 are initially retracted and locked to one another (structural-steel lock 9). The second stage 6 then moves into the base piece of the telescopic part 4, where it is locked in the lock (recess) specifically provided for this purpose (FIG. 1). The structural-steel lock 9 on the telescopic part 3 is released and the telescoping cylinder 10 with the telescopic part 4 is extracted to the maximum (FIG. 3) in order to lock it to the telescopic part 3 there. The cylinder lock 5 is then released and the telescoping cylinder 10 completely retracted. The second cylinder stage 6 is then retracted until it reaches the base piece, where it is locked to telescopic part 3 (FIG. 4). All the telescopic parts 1 to 4 can be extracted one after the other in this manner.

As proposed by the invention, the telescopic system is retracted—in particular likewise automatically—in the sequence described below.

All the telescopic parts 1 to 4 are extracted and locked. The telescoping cylinder 10 is fully extracted and the cylinder lock 5 is locked to the base piece of the telescopic part 1. The structural-steel lock of the telescopic part 1 to the main body 11 is unlocked. The telescopic part 1 is completely retracted with the telescoping cylinder 10 and then locked to the main body 11. The telescoping cylinder 10 is unlocked and completely extracted. The second cylindrical stage 6 is now extracted until the telescopic part 2 reaches the base piece, where it is locked. All the telescopic parts can be retracted one after the other in this manner.

Taking the example of the telescopic part 4, it will now be explained how the advantage of length is obtained by the invention compared with the prior art. The extractable length of the telescopic part 4 is equal to the length $T_{tot}$, due to the movable locking unit 21. Based on the prior art, the length would be shorter by $\Delta T4$, whereas in the case of the invention, it is possible to obtain an increase in length of the jib as a whole in the extracted state by the sum of all the $\Delta T$ values illustrated. Accordingly, the greater the number of telescopic parts, the greater the length advantage is compared with designs known from the prior art. In one standard embodiment, the locking unit 21 may be designed so that it is able to move to the degree that the stroke of the telescoping cylinder 10 need no longer correspond to the distance by which the telescopic part is able to travel. This being the case, the overall stroke of a telescopic part 1 to 4 is divided between the telescoping cylinder 10 and locking unit 21, and the overall length of the telescoping cylinder 10 can therefore be made significantly shorter.

Figure 2:
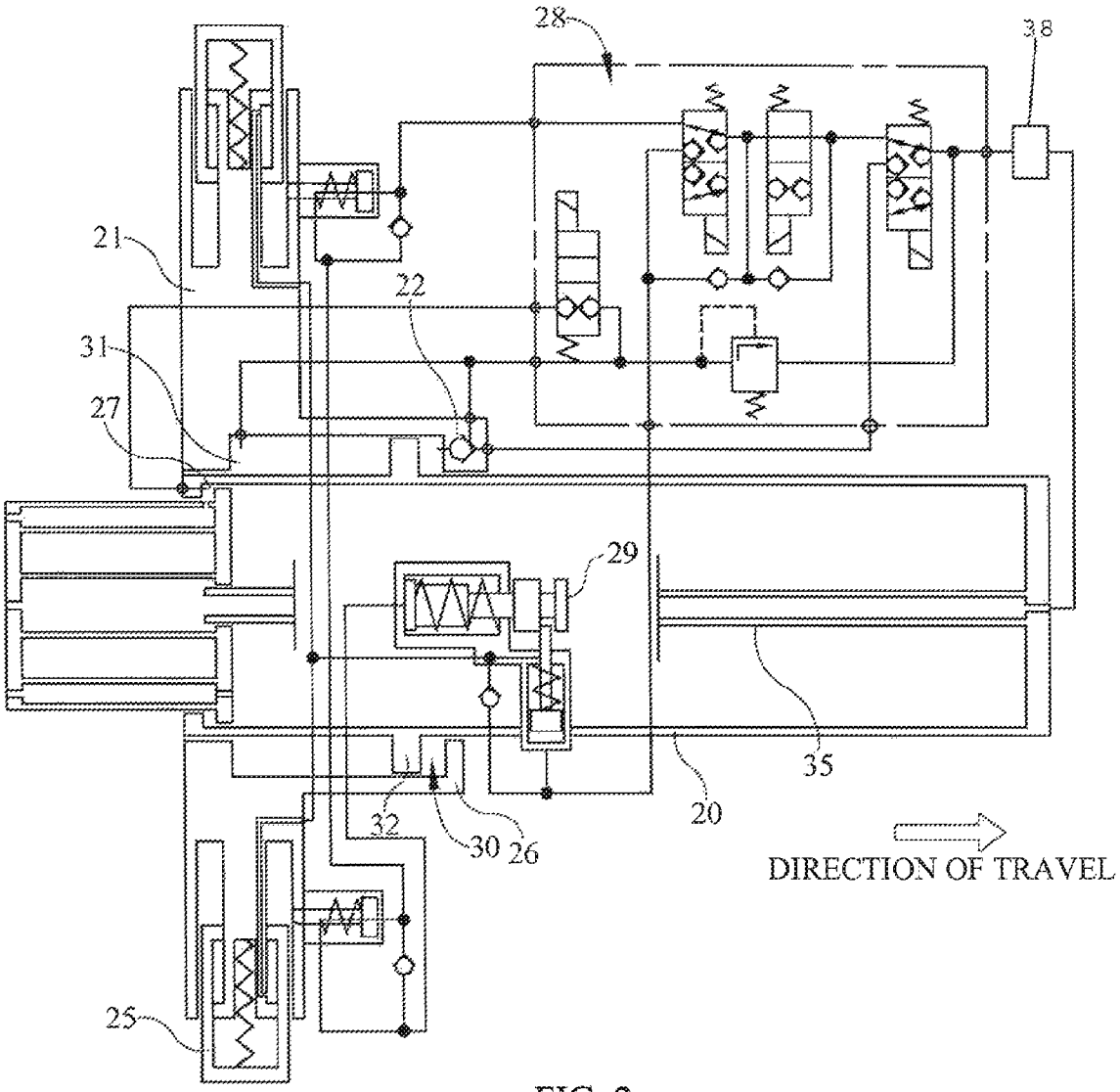
FIG. 2 is a schematic circuit diagram illustrating how a locking system proposed by the invention is activated as well as its hydraulic supply system.

Turning to the schematic circuit diagram shown in FIG. 2, the operating means and hydraulic supply system of a design based on the invention will be explained. In the case of the embodiment illustrated, the second stage of the telescoping cylinder 20 comprises the cylinder tube 26, which surrounds the outer cylinder tube of the actual telescoping cylinder 20. The oil chambers 30 and 31 are supported on the ring 32, which is fixedly joined to the telescoping cylinder 20 (or may constitute a part of it).

The cylinder inlet 35 is used to deliver the hydraulic supply to the valve unit 28. From here, the supply is switched to the cylinder lock 25, structural-steel locking system 29 or second cylindrical stage 26, depending on requirements, in order to move the entire locking unit 21. To obtain an extension in the direction of travel, the ring side 31 remote from the load is connected to the ring side 27 of the telescoping cylinder 20 relieved of pressure. The load side 30 is also connected to the pressurized cylinder inlet 35. A releasable check valve 22 prevents the undesirable reverse movement of the locking unit 21. The oil supply connection to the rod end of the telescoping cylinder can be electrically shut off by shut-off 38.

For retraction purposes, the load-side annular chamber 30 of the locking unit 21 is connected to the cylinder inlet 35, which is relieved of pressure. The annular chamber 31 remote from the load is connected to the pressurised side 27 of the telescoping cylinder 20, causing the releasable check valve 22 to open as a result.

The invention claimed is:

1. A locking system for a telescopic crane jib, comprising: a telescopic crane jib having at least three telescopic parts pinned together by telescopic jib-locks to prevent longitudinal movement of the parts of the telescopic jib when the parts support a load, and having a distance between first and last telescopic jib-locks when the telescopic crane jib is in a retracted state; a telescoping cylinder having an external cylindrical casing; and a locking unit; whereby, in order to extract and retract the telescopic parts, a lock is established by said locking unit between said telescoping cylinder and one of said telescopic parts, and wherein the locking unit is disposed on the telescoping cylinder in such a way that the locking unit can be moved longitudinally with respect to the telescoping cylinder and the locking unit can be fixed to the telescoping cylinder in every position relative to the telescoping cylinder external cylindrical casing, and wherein an overall stroke used to extend a telescopic part is divided between movement of the locking unit and movement of the telescoping cylinder.

2. The locking system as claimed in claim 1, wherein the telescoping cylinder has a first stage and a second stage, and the locking unit is disposed on a second stage of the telescoping cylinder.

3. The locking system as claimed in claim 1, wherein the locking unit can be moved on the telescoping cylinder by a distance corresponding to at least the distance between the first and last telescopic jib-locks when the telescopic crane jib is in the retracted state.

4. The locking system as claimed in claim 1, wherein the locking unit can be moved by more than the distance between the first and last telescopic jib-locks when the telescopic crane jib is in the retracted state so that the movement is effected in addition to the stroke of the telescoping cylinder.

5. The locking system as claimed in claim 1, wherein at least one length-measuring device or length transmitter is provided, which detects the position of the locking unit and telescoping cylinder.

6. The locking system as claimed in claim 1, wherein the locking unit can by moved on the telescoping cylinder by a hydraulic pressure system.

7. The locking system as claimed in claim 1, wherein the locking unit can be fixed on the telescoping cylinder by means of a hydraulically assisted fixing system controlled by a seat valve.

8. The locking system as claimed in claim 1, wherein a hydraulic circuit is provided which controls at least one of an operating means and a fixing means of the locking unit, the hydraulic circuit acting in cooperation with a hydraulic system used for actuating the telescoping cylinder.

9. The locking system as claimed in claim 8, wherein the hydraulic circuit is supplied from an oil inlet of the telescoping cylinder.

10. The locking system of claim 9 wherein the oil supply to the hydraulic circuit uses a connection to a rod end of the telescoping cylinder.

11. The locking system of claim 10 wherein the oil supply to the hydraulic circuit can be shut off electrically.

12. The locking system as claimed in claim 1, wherein the telescoping cylinder has a first stage and a second stage, and the locking unit is designed as the second stage of the telescoping cylinder.

13. The locking system as claimed in claim 1, wherein the locking unit can be moved by more than the distance between the first and last telescopic jib-locks when the telescopic crane jib is in the retracted state so that the movement at least partially replaces the stroke of the telescoping cylinder.

14. A locking system for a telescopic crane jib, comprising:

a telescoping cylinder having an external cylindrical casing within a crane jib defining a longitudinal axis;

at least three telescoping parts coaxially aligned around said telescoping cylinder of said crane jib pinned together by telescopic jib-locks to prevent longitudinal movement of the parts of the telescopic jib when the parts support a load, each of said plurality of telescoping parts movable over said cylinder along said longitudinal axis;

a locking unit disposed on said telescoping cylinder and operable to individually lock each of said plurality of telescoping parts;

wherein said locking unit is longitudinally movable along a portion of said telescoping cylinder with respect to the telescoping cylinder and can be fixed to the telescoping cylinder in every position relative to the telescoping cylinder external cylindrical casing, and wherein an overall stroke used to extend a telescopic part is divided between movement of the locking unit and movement of the telescoping cylinder.

15. The locking system of claim 14 wherein said locking unit comprises a second cylindrical stage positioned about an external cylindrical wall of said telescoping cylinder, said locking unit being disposed on said second cylindrical stage.

16. The locking system of claim 15 wherein said locking unit has a cylindrical lock operable to engage a lock receiving area of each of said plurality of telescoping parts.

17. The locking system of claim 16 further having a hydraulic control operable to secure said locking unit in combination with a hydraulic system in fluid control of said telescoping cylinder.

18. A locking system for a telescopic crane jib, comprising: a telescopic crane jib having at least three telescopic parts pinned together by telescopic jib-locks to prevent longitudinal movement of the parts of the telescopic jib when the parts support a load, and having a distance between first and last telescopic jib-locks when the telescopic crane jib is in a retracted state; a telescoping cylinder having an external cylindrical casing; and a locking unit; whereby, in order to extract and retract the telescopic parts, a lock is established by said locking unit between said telescoping cylinder and one of said telescopic parts, and wherein the locking unit is disposed on the telescoping cylinder in such a way that the locking unit can be moved longitudinally with respect to the telescoping cylinder and the locking unit can be fixed to the telescoping cylinder at every position along the length of the telescoping cylinder external cylindrical casing, including at a position midway along the length of the telescoping cylinder external cylindrical casing.

* * * * *